United States Patent [19]

Bruner

[11] 4,082,054

[45] Apr. 4, 1978

[54] DOCKING AND MOORING DEVICE FOR A BOAT

[76] Inventor: Frank D. Bruner, 10012 Emmett St., Omaha, Nebr. 68134

[21] Appl. No.: 642,319

[22] Filed: Dec. 19, 1975

[51] Int. Cl.[2] ..... B63B 21/00

[52] U.S. Cl. ..... 114/230

[58] Field of Search ..... 114/.5 BD, 218, 230, 114/235 R, 235 WS, 235 A, 235 B, 263, 249, 253, 254; 9/8 R, 8 P; 24/128 R

[56] References Cited

U.S. PATENT DOCUMENTS

| | | | |
|---|---|---|---|
| 3,110,046 | 11/1963 | Fischer | 114/230 |
| 3,398,714 | 8/1968 | Wallin et al. | 114/218 |
| 3,473,505 | 10/1969 | Brown | 114/230 |
| 3,590,767 | 7/1971 | Dunbar | 114/230 |

*Primary Examiner*—Trygve M. Blix
*Assistant Examiner*—Jesus D. Sotelo
*Attorney, Agent, or Firm*—Henderson, Strom, Sturm, Cepican & Fix

[57] ABSTRACT

A device for docking and mooring a boat including a line secured on one end to the boat, a connector secured to the other end of the line, and a guide unit disposed proximate the docking area having a trap for engaging the connector. A method for docking and moving a boat utilizing the above device wherein a boat under powered control approaches the guide unit, the guide unit is engaged by the connector and under continued power the boat is caused to swing in an arc about the guide unit as it moves into its docking area.

7 Claims, 8 Drawing Figures

DOCKING AND MOORING DEVICE FOR A BOAT

BACKGROUND OF THE INVENTION

This invention relates generally to a docking and mooring device and method for a boat. The presently known mooring device utilizes a line and a cleat wherein one end of the line is secured to a boat and the cleat is secured to a dock. Upon docking the boat, the other end of the line is wrapped around the cleat. This device does not in any way assist in docking the boat and merely provides a way to secure or anchor the boat, and then only after having a second party perform the act of securing the line. A boat operator does in some instances secure the line to the cleat, but he does so at considerable risk to his safety as he may have to jump to the dock or lean over the water.

It has also been observed that many boat operators, particularly in the wind or current, have a difficult time of properly approaching the dock. As a result, either the boat or the dock, or both, are damaged, or the operator may make several attempts before he safely brings the boat along side the dock. Reference to the art fails to disclose any method of properly docking or a device which aids in the mooring of a boat without leaving the boat or utilizing other parties to assist therein.

SUMMARY OF THE INVENTION

This invention relates to docking and mooring device for a boat and a method for properly approaching, docking and mooring a boat by use of the device. The device includes a guide unit disposed proximate a dock, a line having one end secured to a boat and having a connector secured to the other end thereof for coacting with the guide unit. When the guide unit is properly placed proximate a docking area and the connector secured to the guide unit, continued movement of the boat will cause it to pivot about the guide unit into a docking area.

The object of this invention is the provision of an improved docking and mooring device for a boat.

Another object of this invention is the provision of method for docking and mooring a boat by use of a connector unit and a guide unit.

A further object of this invention is to provide a device which does not require any skill to operate; thus permitting substantially anyone to properly dock and moor a boat in a heavy wind and/or current situation.

Yet another object of this invention is to provide an improved device for docking and mooring a boat which is durable of construction, inexpensive of manufacture and extremely effective in use.

These objects and other features and advantages become more readily apparent upon reference to the following description when taken in conjunction with the appended drawings.

In the drawings as hereinafter described, a preferred embodiment and a modified embodiment of the invention are illustrated, however, various modifications can be made thereto without departing from the true spirit and scope of the invention.

DESCRIPTION OF THE EMBODIMENT

Figure 1:
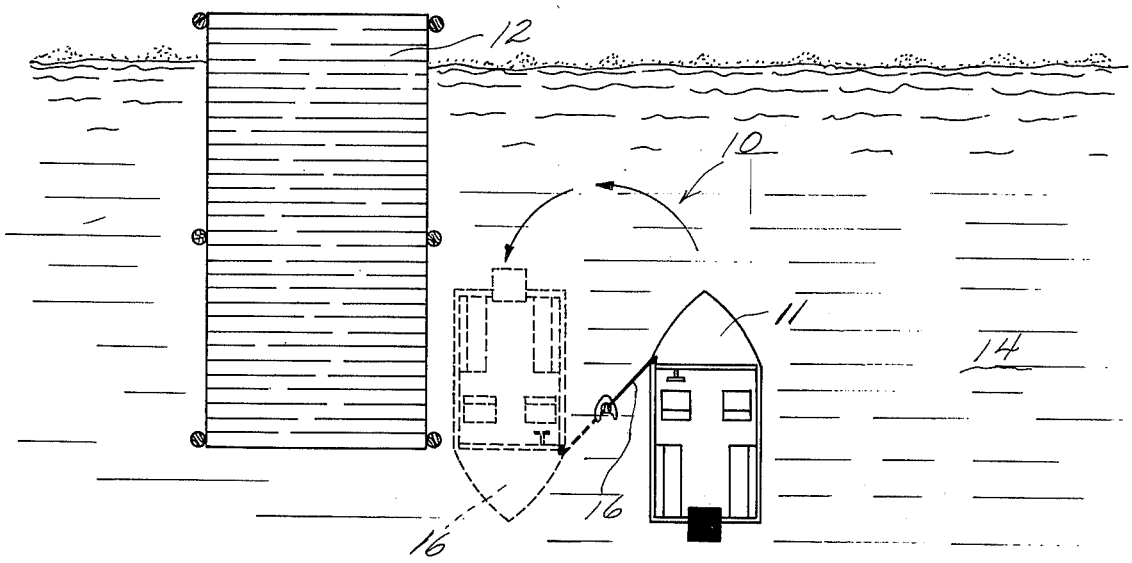
FIG. 1 is a top plan view of the device of this invention as it relates to a boat and a dock.
Figure 2:
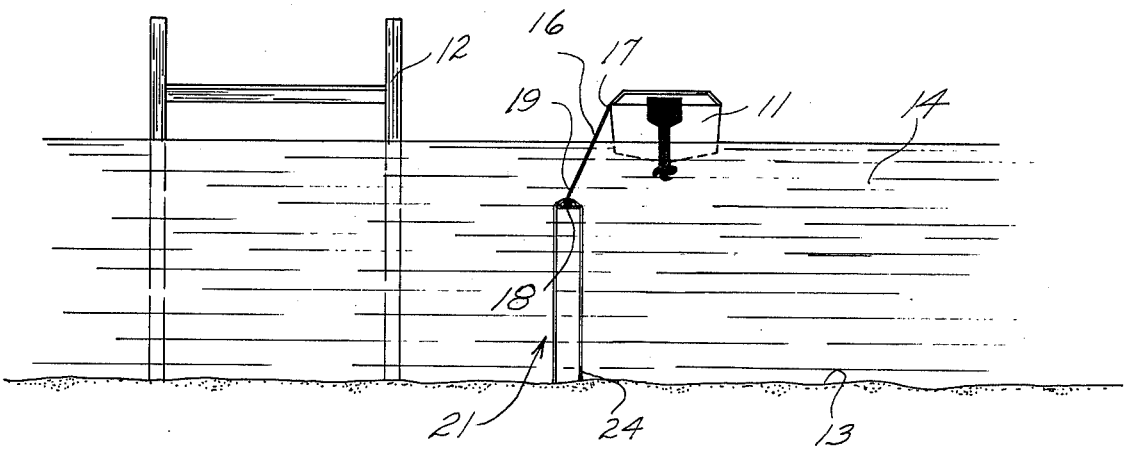
FIG. 2 is an elevational view thereof in combination with a boat and a dock.

Referring now to the drawings, the improved docking and mooring device of this invention is disclosed generally at 10 in FIGS. 1 and 2. The device 10 is shown in combination with a boat 11, a dock 12 and the bottom 13 of a lake 14; includes a line 16 secured on one end 17 to the boat 11, a connector unit 18 secured to the other end 19 of the line 16, and a guide unit 21 secured to or deposited on the bottom 13 of the lake 14.

The connector unit 18 (FIGS. 1 and 4) is a weighted ball 22 which is secured to the forward end of the boat proximate the position the boat operator would normally occupy. The length of the line 16 is slightly longer than the depth of the lake from its surface to the guide unit 21.

Figure 3:
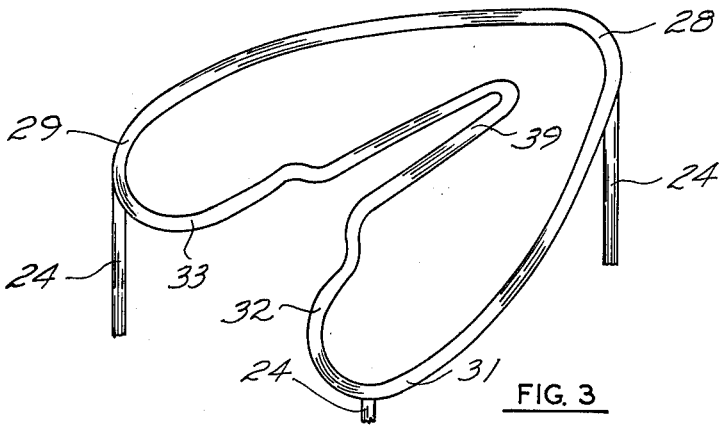
FIG. 3 is a perspective view of the guide unit thereof.
Figure 4:
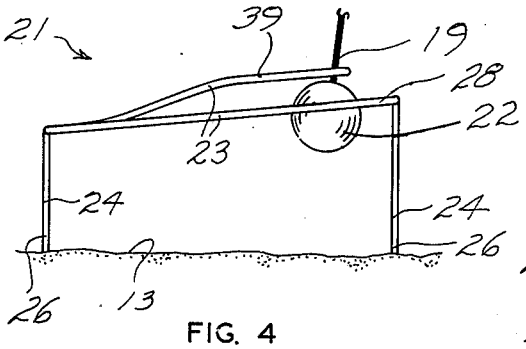
FIG. 4 is a side elevational view of the guide unit thereof.
Figure 5:
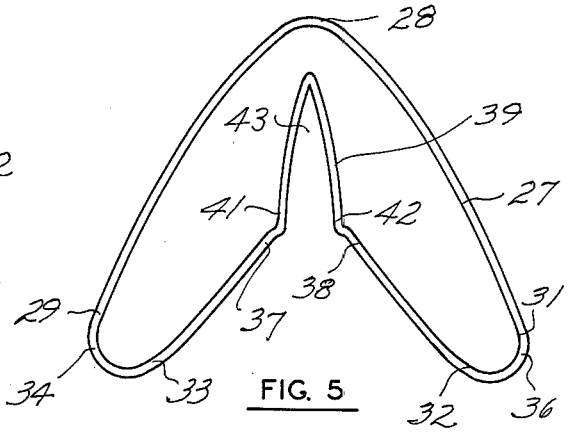
FIG. 5 is a top plan view of the guide unit thereof.

Referring to FIGS. 3–5, the guide unit 21 is depicted as having a body portion 23 secured to a plurality of legs 24 extending perpendicular therefrom. The shank end 26 of each leg is disposed in the ground or secured to the ground. The body portion 23 is formed from a single rod, or the like, and includes an arcuate outer rim 27 having an intermediate section 28 and a pair of diverging ends 29 and 31. Secured to the ends 29 and 31 of the arcuate outer rim 27 are a pair of curved sections 32 and 33. Each curved section has one end 34 or 36 integral with the outer rim ends 29 or 31 and the other end 37 and 38 thereof converge and bend upwardly and toward the intermediate section 28 within the outer rim 27. A V-shaped inner rim 39 is integral on its free ends 41 and 42 with the other ends 37 and 38 of the curved sections to form an endless element. The inner rim 39 and a portion of the curved sections 32 and 33 are offset or raised to form a trap or snare 43. It will be noted in FIG. 4 the intermediate section of the outer rim 27 is disposed above the ends thereof thereby placing the apex of the inner rim 39 above the rest of the guide unit 21. In addition the distance between the arms of the inner rim is less than the diameter of the ball 22.

In the method of docking the boat FIG. 1 and 2), the operator approaches the area of the guide unit 21 under power and throws the weighted ball 22 overboard. The boat should be under the full control of the operator and moving toward the guide unit. When the boat passes generally over the guide unit, the line will engage the curved sections 32 and 33 and be directed into the inner rim 39. As the boat continues its forward motion, the ball 22 will engage the inner rim and the boat will turn about the guide unit into a docking position (FIG. 1). If the line is snubbed tightly, the ball will be forced to remain engaged in the inner rim; thus generally preventing the boat from drifting off. To disengage the ball from the guide unit, the line is loosened from the snare 43 and the ball will drop below the inner rim to permit the boat to move away from the dock.

Figure 6:
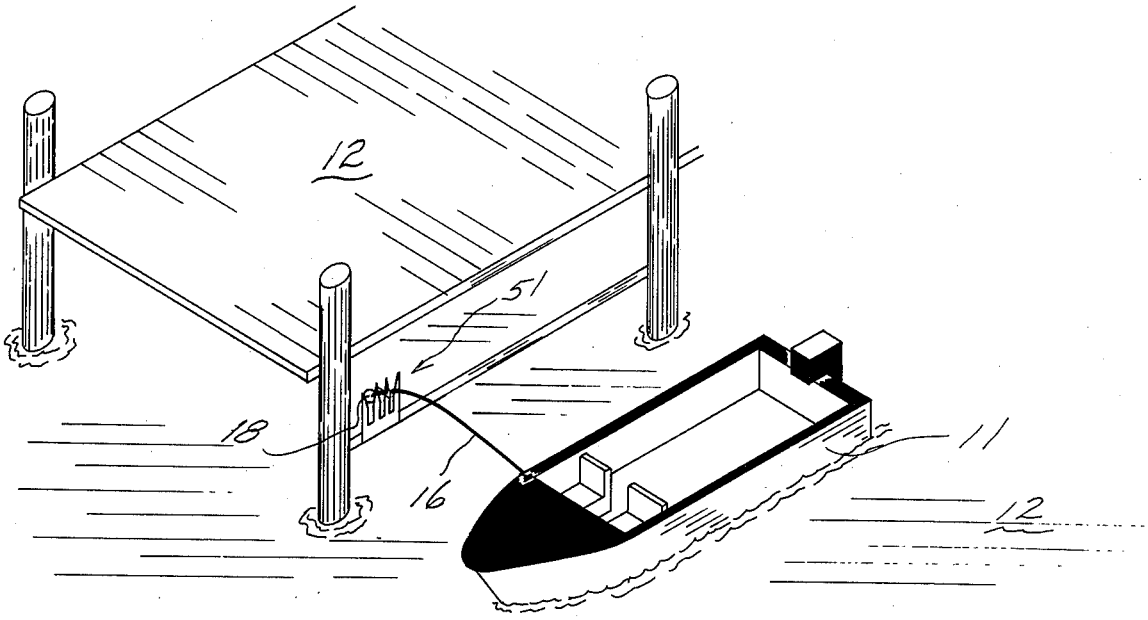
FIG. 6 is a perspective view of a modified embodiment of the device in combination with a boat and a dock.
Figure 7:
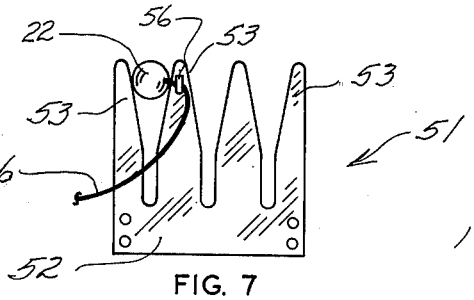
FIG. 7 is a front elevational view of the modified embodiment.

A modified embodiment of the guide unit 51 is depicted in FIGS. 6 and 7. The unit includes a plurality of teeth 53 secured to a base 52. The base 52 may either be secured to a dock with the free ends of the teeth projecting upwardly to permit a line with a ball to be thrown thereover to moor a boat or the unit 51 may be mounted on the floor of the lake. In the latter mode, the base 52 is secured to at least one leg (not shown but similar to the leg 24 of the preferred embodiment of the guide unit 21), and the shank of the leg is fixed to the floor of the lake. The guide unit should be sloped wherein the free ends of the teeth slant downwardly as in FIG. 4. The method of docking is similar to the method as described hereinabove, however, now a plurality of inner rims, or areas between teeth, are presented to engage the line 16 and ball 22.

Although not depicted in the drawings, the guide unit of either embodiment can be mounted above the surface of the water on a pole, and the boat can be docked in much the same way as described above. It is only necessary to mount one end of the line off center of the longitudinal axis of the boat and the guide unit is then approached from the side opposite that which the boat is to be docked. It will also be obvious from the discussion above that the guide unit can be mounted on the boat and the line and weight can be secured to the dock for mooring purposes. For docking purposes, the line is secured to the floor of the lake and a buoyant ball is secured to the other end wherein the guide unit projects outwardly from the boat just below the surface of the water to enable the guide unit to snare the buoyant ball.

Figure 8:
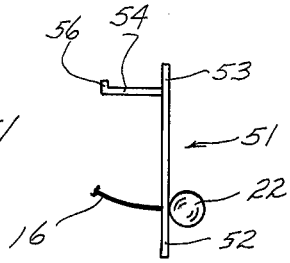
FIG. 8 is a side elevational view thereof.

Either the preferred or the modified embodiment of the invention may be used solely as a mooring device by mounting it on a dock 12 with the open end of the inner rim or the teeth projecting upwardly or away from the area in which the boat is moored. To release the connector from the guide unit 21 or 51, a disconnector boss 54 (FIGS. 7 and 8) is secured proximate the ends of one of the teeth 53 or proximate one of the diverging ends 29 or 31 (not shown). The boss 54 is secured on one end to the guide unit and the free end projects normally therefrom. The free end has a hook element 56 integral therewith which projects normally to the boss. To disconnect the connector 18 from the guide unit, the operator flips the end 19 of 16 over the boss 54 and pulls the line wherein the connector will slip out of the guide unit.

As is readily seen, the docking and mooring device functions under a simple principle of operation. Obviously, many modifications and variations of the present invention are possible in light of the above teachings. It is, therefore, to be understood that within the scope of the appended claims the invention may be practiced otherwise than as specifically described.

I claim:

1. A docking and mooring device for a boat comprising:

a line adapted to be secured on one end to the boat;

a connector secured to the other end of said line; and a guide unit disposed proximate the docking position of the boat and having an open ended trap including an inner rim formed in a generally V-shaped configuration for co-acting with said connector, said guide unit includes an arcuate outer rim having diverging ends; a pair of curved sections, each integral on one end with one of said diverging ends with the other ends thereof converging toward each other; and said V-shaped inner rim forming said trap is disposed substantially within said outer rim with the free ends thereof integral with said converging ends thus forming an endless element.

2. A docking and mooring device as defined in claim 1 wherein said inner rim is offset from said outer rim.

3. A docking and mooring device as defined in claim 2 wherein the size of said offset is smaller than said connector.

4. A docking and mooring device as defined in claim 1 wherein said guide unit is secured to the floor of a body of water and said connector is weighted.

5. A docking and mooring device as defined in claim 4 wherein said guide unit is secured to the floor of the body of water against lateral movement of said guide unit relative to the floor of the body of water.

6. A docking and mooring device as defined in claim 5 wherein said guide unit is secured below the surface of the body of water.

7. A docking and mooring device for a boat comprising:

a line adapted to be secured to the boat;

a connector secured to the other end of said line; and a guide unit disposed proximate the docking position of the boat including a base having a plurality of spaced teeth projecting away therefrom forming a plurality of open ended traps, and further including a disconnector secured to said guide unit and cooperably with said line for disengaging said connector, said disconnector including a boss having one end secured to said guide unit proximate said open ends of said traps and having a free end projecting substantially normally from said guide unit, and a hook element integral with said boss free end.

* * * * *